US006811292B2

(12) United States Patent
Christenson

(10) Patent No.: US 6,811,292 B2
(45) Date of Patent: Nov. 2, 2004

(54) CHARGE HOPPER FOR TRANSIT CONCRETE MIXER

(75) Inventor: Ronald E. Christenson, Parson, TN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 10/356,834

(22) Filed: Feb. 3, 2003

(65) Prior Publication Data

US 2004/0151057 A1 Aug. 5, 2004

(51) Int. Cl.[7] ..... B28C 7/04
(52) U.S. Cl. ..... 366/41; 193/10
(58) Field of Search ..... 366/41, 54, 45; 193/10, 17, 14

(56) References Cited

U.S. PATENT DOCUMENTS

| | | | | |
|---|---|---|---|---|
| 899,414 | A | | 9/1908 | Koehring |
| 968,275 | A | * | 8/1910 | Smith ..... 366/41 |
| 1,821,056 | A | | 9/1931 | Durham |
| 1,946,222 | A | | 2/1934 | Mandt |
| 2,265,751 | A | | 12/1941 | Ball |
| 2,316,137 | A | | 4/1943 | Visser |
| 2,395,571 | A | | 2/1946 | McMillan |
| 2,501,944 | A | | 3/1950 | Jaeger et al. |
| 2,511,262 | A | * | 6/1950 | Hilkemeier ..... 366/41 |
| 2,589,492 | A | | 3/1952 | Graham |
| 2,750,164 | A | | 6/1956 | MacKinney |
| 2,880,977 | A | | 4/1959 | Maxon, Jr. |
| 2,904,318 | A | | 9/1959 | Broberg |
| 2,997,213 | A | | 8/1961 | Richards et al. |
| 3,061,063 | A | | 10/1962 | Rutten |
| 3,131,913 | A | | 5/1964 | Swarthout |
| 4,009,868 | A | | 3/1977 | Blind |
| 4,154,534 | A | | 5/1979 | Lawrence et al. |
| 4,318,621 | A | | 3/1982 | Lawrence et al. |
| 4,428,677 | A | | 1/1984 | Schreiter, Jr. |
| 4,498,568 | A | | 2/1985 | Christenson |
| 4,762,421 | A | | 8/1988 | Christenson et al. |
| 5,154,488 | A | | 10/1992 | Maxon, III |
| 5,884,998 | A | | 3/1999 | Silbernagel |
| 6,350,051 | B1 | | 2/2002 | Cain |

* cited by examiner

*Primary Examiner*—Tony G. Soohoo
(74) *Attorney, Agent, or Firm*—Nikolai & Mersereau, P.A.; C. G. Mersereau

(57) ABSTRACT

A two-piece charge hopper assembly for a concrete transit mixing vehicle of the rear-discharge type is disclosed in which a lower, movable portion including the hopper discharge lip is enabled to swing out of the way of discharging concrete while the upper body of the charge hopper remains in a fixed position which is accomplished by the use of a simple pivot mechanism.

5 Claims, 7 Drawing Sheets

CHARGE HOPPER FOR TRANSIT CONCRETE MIXER

FIELD OF THE INVENTION

The present invention relates generally to transit concrete mixing trucks and, more particularly, to charge hoppers associated with such trucks. The charge hoppers of the present invention are provided with lower segments which have the ability to pivot and swing free of the path of concrete discharged from the mixing drum.

RELATED ART

Current transit concrete mixing vehicles include a drum having an inclined axis and an opening on the raised end which serves both to receive materials to be mixed and to discharge concrete during a pour. These drums are typically provided with fixed spiral mixing blades which move the ingredients toward the lower end of the drum for mixing when the drum is rotated in a first direction and discharge the mixed ingredients when the drum is rotated in the opposite direction. To facilitate the loading of the drum, a funnel-shaped charge hopper is mounted in relation to the drum opening and is used to introduce materials into the drum for mixing. An outlet collector chute is also provided to collect and control the concrete as it is being discharged from the drum.

Typically, outlet end of the charge hopper is positioned into the drum a short distance to prevent spillage during the loading process. Unfortunately, this lower end of the charge hopper may impede the flow of concrete as it is being discharged, particularly if the concrete is quite stiff and viscous, such as that used in forming predetermined shapes such as curbing along streets, for example.

A fragmentary side view of the rear portion of a typical transit concrete mixer truck with the charging hopper in the lowered or loading position is depicted generally at 10 in FIG. 1 and includes a chassis frame 12 which includes heavy structural side rails as at 14 and is normally supported on road engaging wheels as at 16. An auxiliary tag axle assembly is shown generally at 18 attached to the rear end of the frame 12 with the tag axle assembly in the lowered ground engaging, truck supporting position. That system is operated by a linear actuator 20 operating on a horn arm 22 which, in turn, pivots a pair of primary torque arms, one of which is shown at 24, about pivotal connections, one of which is shown at 26.

Rotatably supported above the frame is a cement or concrete carrying transit mixing drum 28 having a rear support which includes a pair of heavy support pedestal members, one of which is shown at 30. The drum 28 rides and rotates in the rear support structure on a drum support ring 32. A front support and drive mechanism are also provided which are well known in the art and need not be shown here. The edge of the open end (and thus, the opening) of the drum 20 is depicted by ring 34. A charging hopper is shown at 36 having a lower portion which extends into the open end of the drum at 38 and which assembly pivots about a pivot joint at 40. A lower stop support assembly is shown at 42 and a hollow discharge or outlet collector chute is shown at 44. This concrete transit mixing vehicle also includes a folding discharge chute as is shown generally at 46 for receiving the concrete material discharged from the collector chute 44 and directing the flow of concrete to the desired discharge location while avoiding the tag axle system.

The conventional charge hopper assembly is better depicted in the enlarged fragmentary views of FIGS. 2 and 3. FIG. 2 depicts a charge hopper assembly similar to that shown in FIG. 1 in the normal lowered charge or loading position. Note that the lower end portion 46 of the charge hopper 36 protrudes well into the open end of the drum 28 beyond line 34. A linear operator, generally at 48, is provided including a cylinder 50 and piston 52, pivotally mounted between the hopper 36 at 54 and a pivotal joint 56 attached to the structural support for the drum at 56.

As can be seen in FIG. 3, extending the piston 52 of the cylinder 50 pivots the entire charge hopper 36 up a sufficient distance so that the outlet end of the hopper is pivoted away from the open end of the mixer drum, depicted by 34, a sufficient distance so that the outlet end 46 of the charge hopper no longer interferes with the flow of material out from the drum through the discharge chute 44. In addition to facilitating the discharge of concrete from the drum, particularly highly viscous concrete, the ability to swing the entire hopper out of the way has the added advantage of facilitating cleaning of the outlet of the drum.

While the raising of the entire charge hopper may successfully deal with the problem associated with the discharge of low slump, highly viscous concrete and may facilitate the cleaning of the outlet area of the drum, it adds several feet to the necessary possible clearance height of the vehicle as it adds to the overall height of the vehicle when it is in the raised position. It also requires one or more linear actuators which have the capacity to raise and lower the entire hopper which may weigh several hundred pounds. For these and other reasons, it would be advantageous if the same clearance could be achieved with regard to discharging concrete and cleaning the outlet end of the drum without changing the overall height dimension of the transit concrete mixing vehicle.

One such approach has been suggested in U.S. Pat. No. 6,350,051 to Cain which involves a front discharging ready-mix concrete truck. That patent depicts a charge hopper assembly having a main chute portion and a movable portion located adjacent to the concrete truck mixing drum. The movable portion is attached to the main chute assembly and is movable between an open position and a closed position utilizing a linear actuator and a rather complicated linkage system necessary to enable the movable portion to swing free of the fixed main chute portion of the charge hopper.

Thus, it would present a definite advantage to provide a system in which the lower portion of the charge hopper including the bottom lip could swing out of the way of discharging concrete while the upper body of the charge hopper remained in a fixed position in a manner which is accomplished by a simplified rather than a complicated mechanical pivot system.

SUMMARY OF THE INVENTION

By means of the present invention, there is provided a two-piece charge hopper assembly for a concrete transit mixing vehicle of the rear-discharge type in which a lower, movable portion including the hopper discharge lip is enabled to swing out of the way of discharging concrete while the upper body of the charge hopper remains in a fixed position which is accomplished by the use of a simple pivot mechanism. The pivot mechanism of the invention includes a pair of simple pivot connections located one on each side of the upper hopper body, each of which has a connected pivot or lever arm member which, in turn, is attached at its free end to one side of a generally conical movable lower section of the charge hopper. The two pivot or lever arm members flank the upper section. A pair of simple linear actuators, preferably fluid operated actuators such as hydraulic or pneumatic cylinder, are connected, one each between a central part of each lever arm, preferably at a location closer to the lower section, and the mixing drum support in a manner such that extension of the linear operators pivots the lever arms and so the movable portion of the charge hopper a sufficient distance to clear discharging concrete of any viscosity.

BRIEF DESCRIPTION OF THE DRAWINGS

In the drawings wherein like numerals are utilized to designate like parts throughout the same.

DETAILED DESCRIPTION

An example of the swing-away lower section charge hopper assembly of the present invention is depicted in FIGS. 4–7 that accomplishes swinging away of the lower end of the charge hopper assembly including the discharge lip utilizing a mechanically simple and uncomplicated system which eliminates intermediate linkage members which are subject to corrosion, wear and clogging over the course of the operating life of the device and which may increase maintenance costs.

Figure 1:
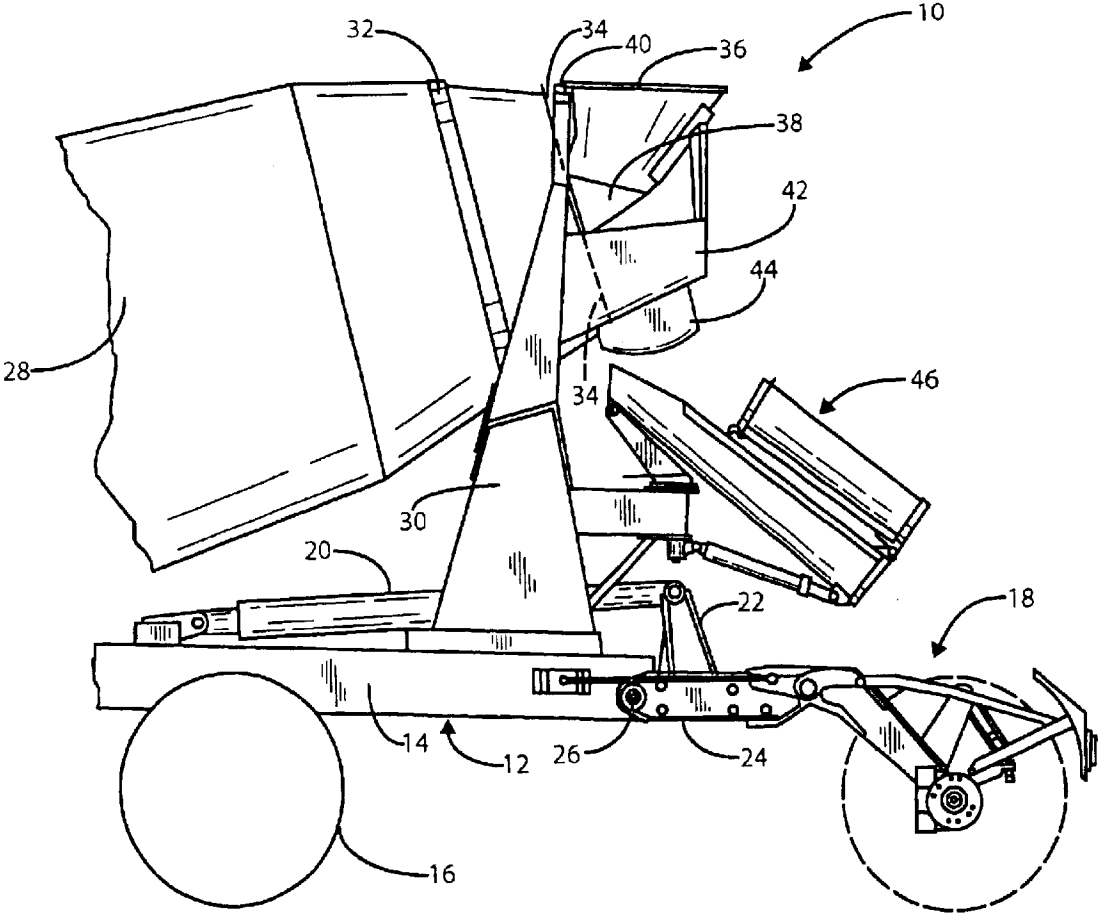
FIG. 1 (PRIOR ART)
FIG. 1 depicts a fragmentary side view of the rear portion of a typical prior art transit concrete mixing vehicle shown with the charging hopper lowered in the charge or loading position.
Figure 2:
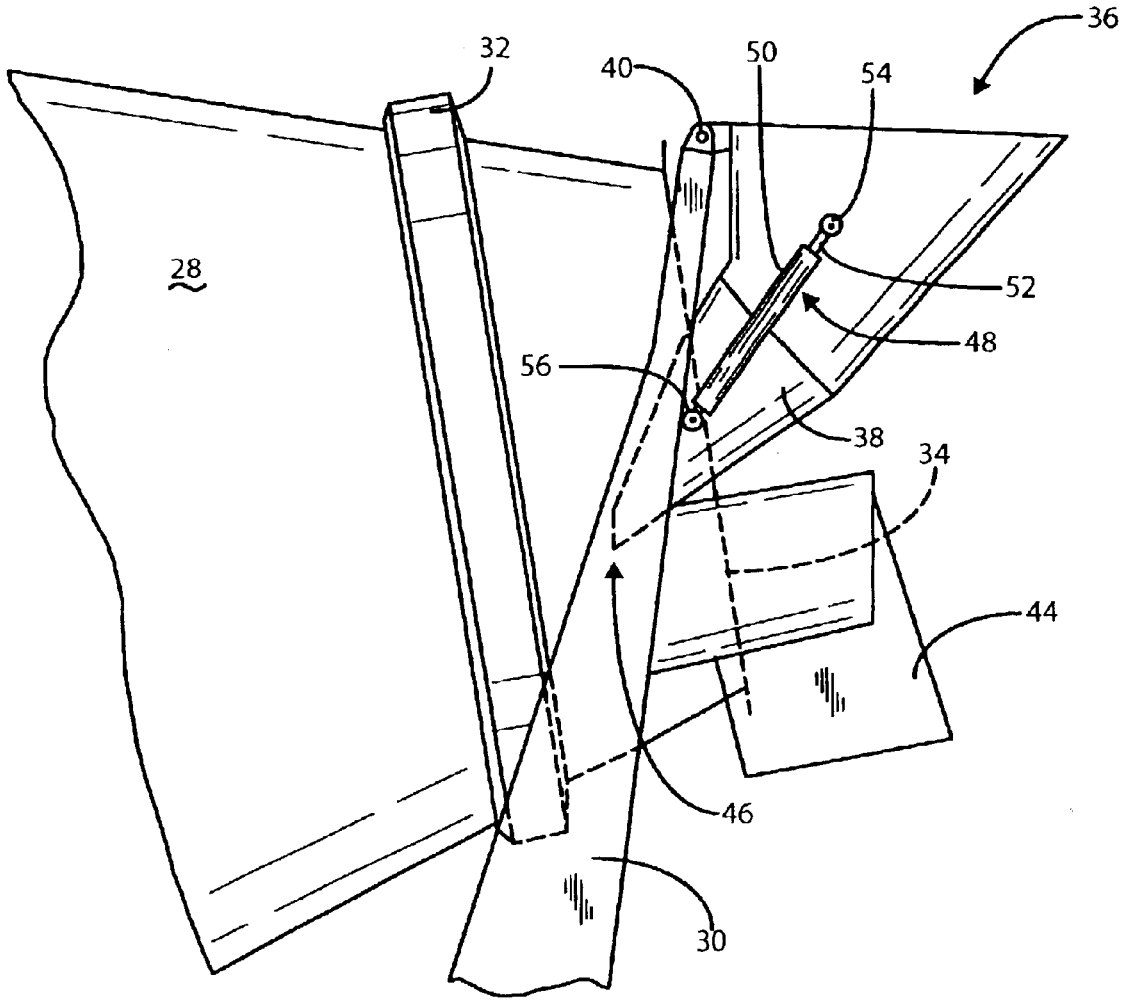
FIG. 2 (PRIOR ART)
FIG. 2 is an enlarged view of a charge hopper assembly as in FIG. 1.
Figure 3:
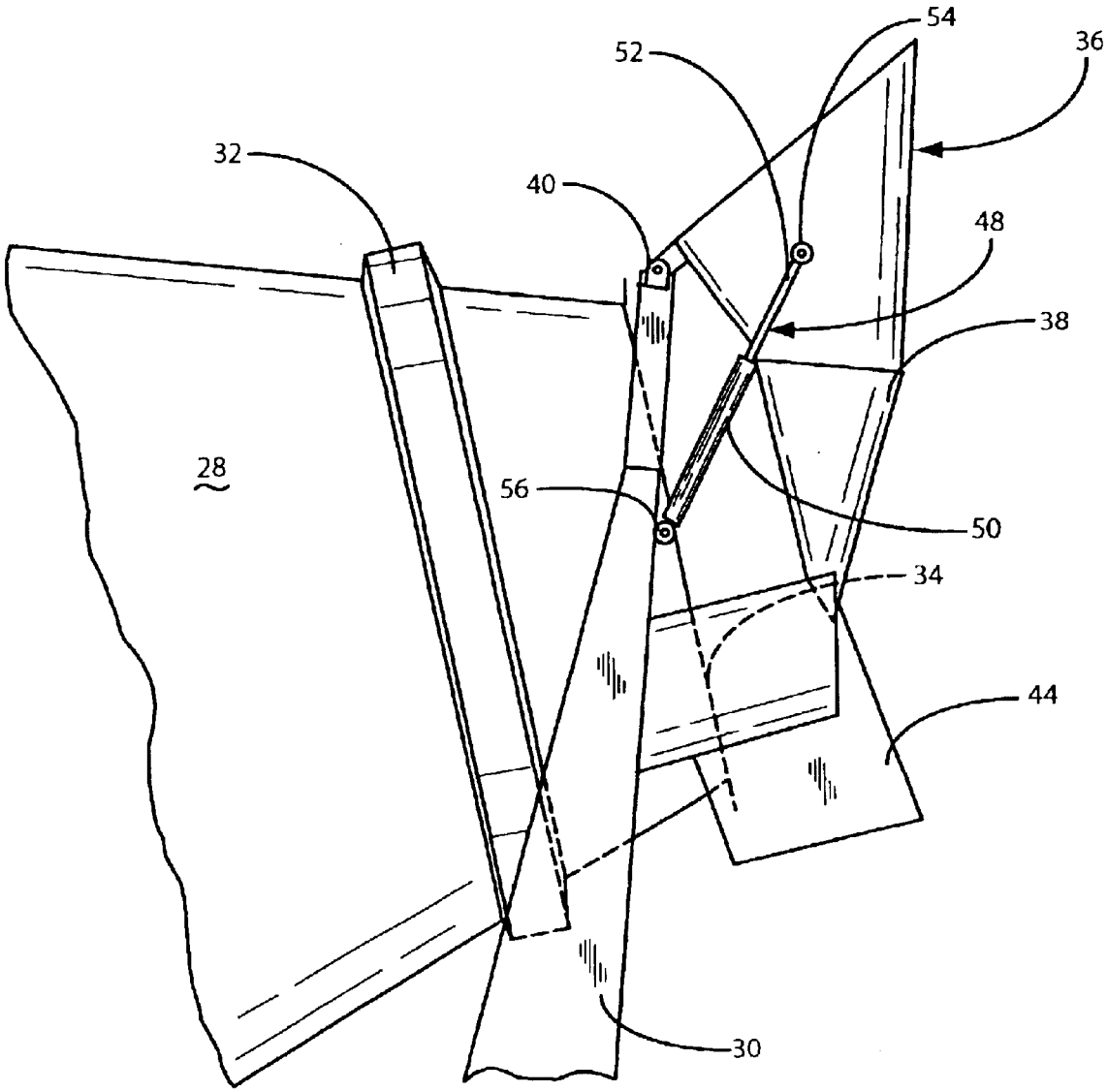
FIG. 3 (PRIOR ART)
FIG. 3 is a view similar to FIG. 2 showing the charge hopper in the lifted, unloading or cleaning position.
Figure 4:
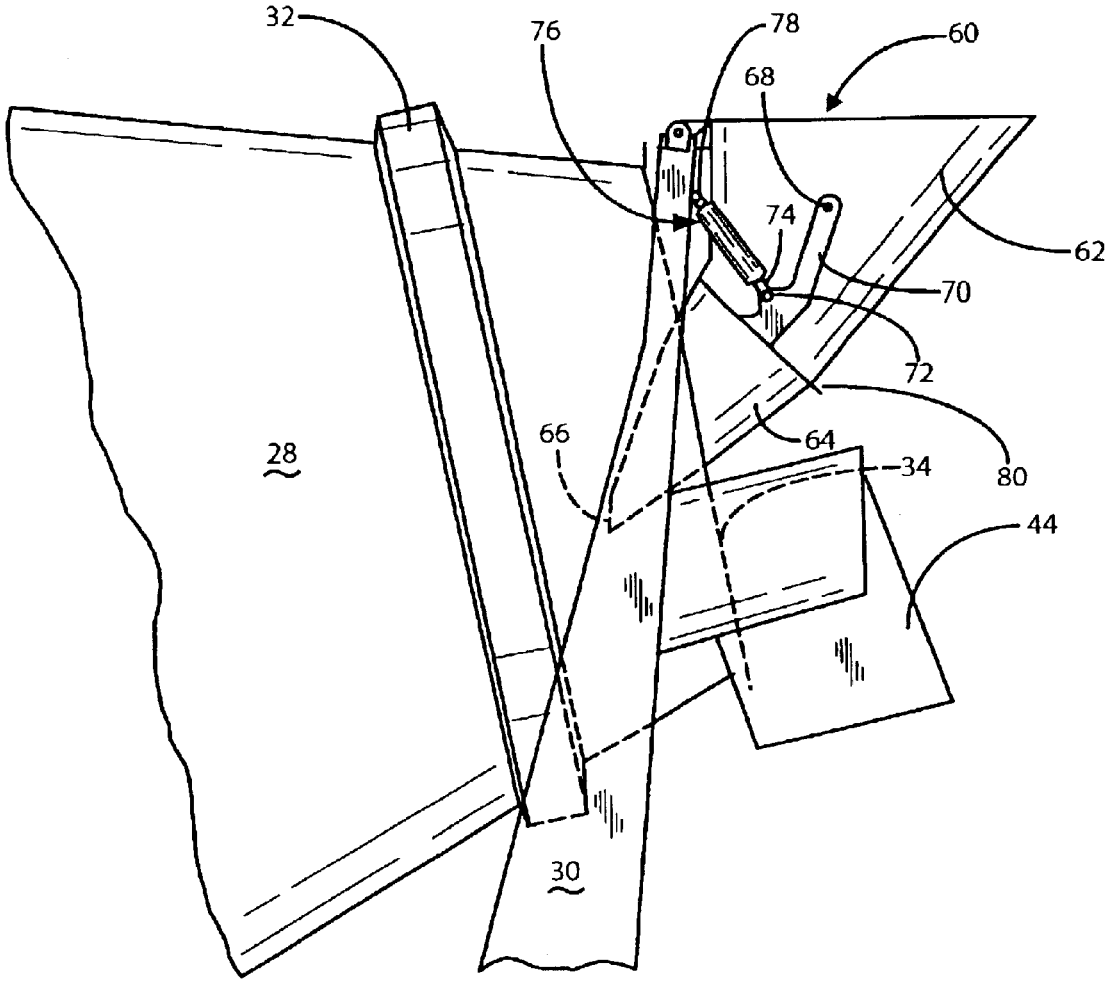
FIG. 4 is an enlarged fragmentary view of a charge hopper assembly implemented according to the present invention with the swing-away lower section shown in lowered or loading disposition.

As seen in the figures, the charge hopper of the invention shown generally at 60 includes a hollow upper section or charge hopper inlet body 62 for material receiving having an open top and an open bottom; and a swing-away lower charge hopper section or fill-guiding section 64 having an open semi-circular top that aligns with the open bottom of the upper section 62 and an outlet opening that directs material received by the upper section into the mixer drum 28 and which includes at the lower end, a discharge lip shown extending inside the opening in the drum 28 is depicted by the broken line 66 in FIG. 4.

The upper charge hopper inlet body 62 is provided with a pair of flanking pivot connections shown at 68 (see FIG. 6) and each of which carries a lever arm, shown at 70, and each of which have an additional pivot joint as at 72 which connects to the piston end 74 of a linear actuator 76, the blind end of which is connected to a pivot joint (which may be a clevis connection) at 78. The lower end of lever arm 70 is connected to the swing-away lower section of the charge hopper 64 which is provided with a hoop frame 80 provided in the swing-away lower section 64.

Figure 5:
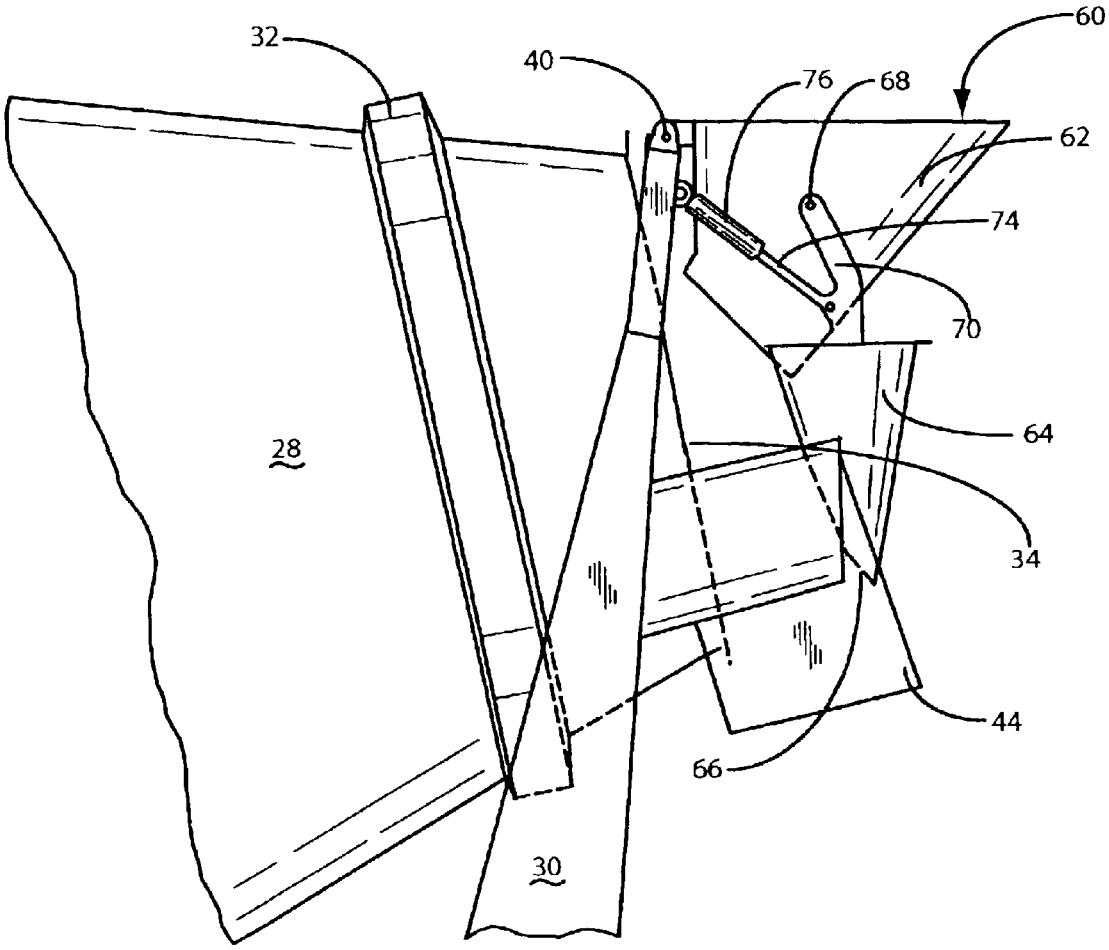
FIG. 5 is a view similar to FIG. 4 with the swing-away lower section in the raised or discharge position.
Figure 6:
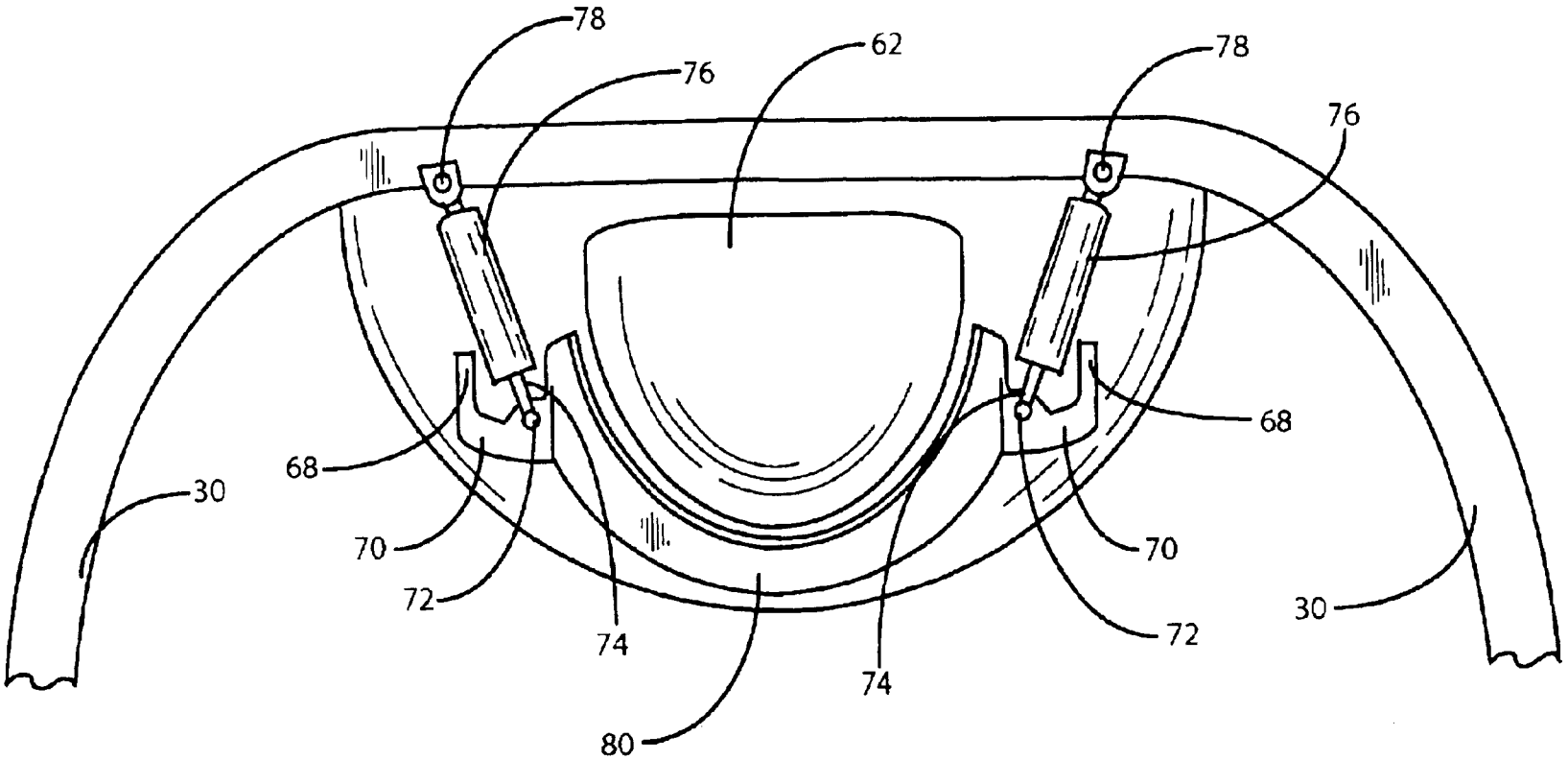
FIG. 6 is a top view of the charge hopper assembly of FIGS. 4 and 5 with parts removed for clarity.
Figure 7:
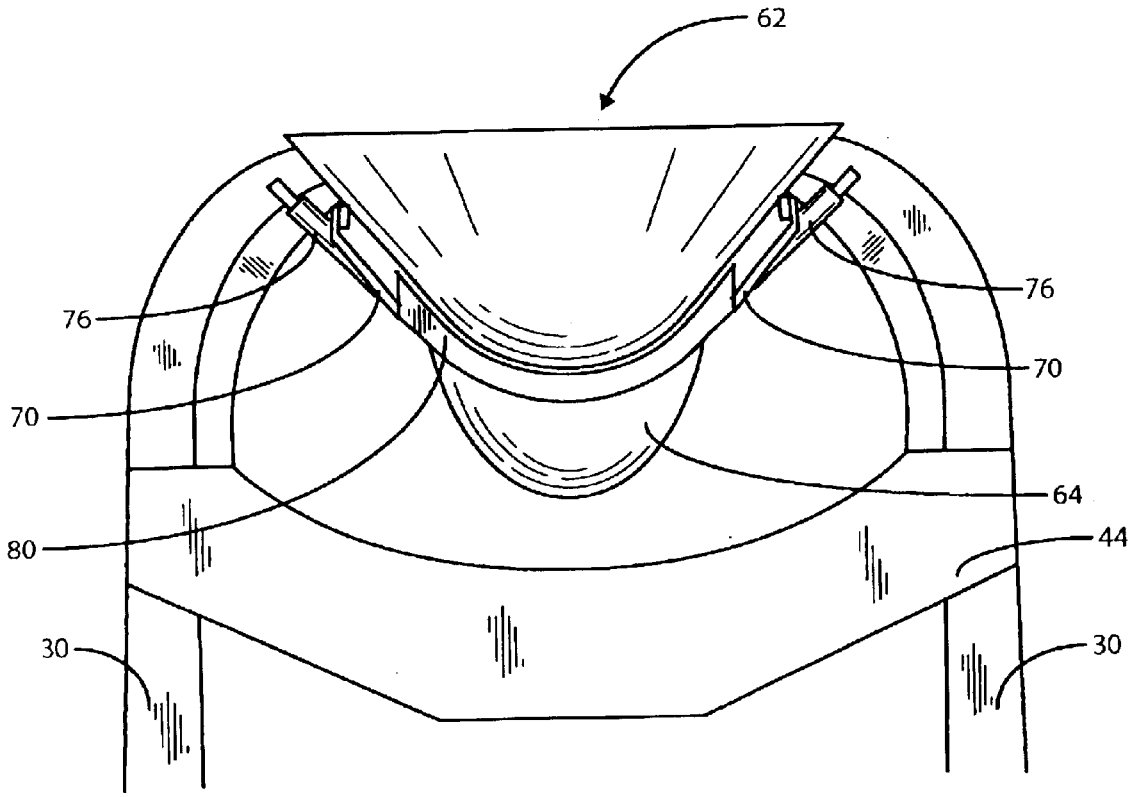
FIG. 7 depicts a rear view of a charge hopper assembly as shown in FIG. 4.

In FIG. 5 the linear actuator 76 is shown with piston 74 fully extended and the lower swing-away section of the charge hopper is in the discharge or clear position leaving the discharge chute 44 clear to receive concrete discharge from the opening at 34. Thus, the entire mechanism operating the lower swing-away section of the charge hopper requires only a pair of cylinders and a pair of swing arms to accomplish the task. Also, note that only a small relatively light weight open-sided portion of the charge hopper need be moved. The small fill-guiding portion can swing directly away from the main loading chute 62. This leaves the opening clear for discharging materials as needed. Thus, it can be seen that access to the fill-discharge opening can be controlled by a simple manipulating system for swinging a small fill-guiding chute section out of the way for discharge and back into a nesting arrangement for loading.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A charging hopper assembly for a transit concrete mixer vehicle including a rotatable mixing drum comprising:

(a) a hollow upper section for material receiving having an open top and an open bottom;

(b) a generally conical swing-away lower section having an open top that aligns with said open bottom of said upper section in a charge position and an outlet opening that directs material received by said upper section into said mixing drum;

(c) a pair of lever arms flanking said upper section and pivotally attached thereto at a fixed end and attached to said lower section at a free end thereby carrying said lower section in a pendulum relation to said upper section; and (d) a pair of linear actuators pivotally connected between said pair of lever arms and said mixer vehicle for controlling the relative angular position between said upper section and said lower section such that extension of said linear operators swing said lever arms and said lower section out of alignment with said upper section and away from said drum.

2. A charging hopper assembly as in claim 1 wherein said linear actuators are fluid operated cylinders.

3. A charging hopper assembly as in claim 2 wherein said fluid operated cylinders are double-acting hydraulic cylinders.

4. A charging hopper assembly as in claim 3 wherein said linear actuators are pivotally connected to said lever arms at a location closer to said lower section.

5. A charging hopper assembly as in claim 1 wherein said linear actuators are pivotally connected to said lever arms at a location closer to said lower section.

* * * * *